US008157510B2

(12) United States Patent
Bear et al.

(10) Patent No.: US 8,157,510 B2
(45) Date of Patent: Apr. 17, 2012

(54) FLEXIBLE IMPELLER APPARATUS AND METHOD

(75) Inventors: Patrick A. Bear, Richfield, MN (US); Matthew A. Cottrell, Woodbury, MN (US); Michael L. Linsdau, Hoffman Estates, IL (US); David G. Vensland, Champlin, MN (US)

(73) Assignee: Sta-Rite Industries, LLC, Delavan, WI (US)

( * ) Notice: Subject to any disclaimer, the term of this patent is extended or adjusted under 35 U.S.C. 154(b) by 721 days.

(21) Appl. No.: 12/256,306

(22) Filed: Oct. 22, 2008

(65) Prior Publication Data

US 2009/0180879 A1 Jul. 16, 2009

Related U.S. Application Data

(60) Provisional application No. 60/999,893, filed on Oct. 22, 2007.

(51) Int. Cl.

| | |
|---|---|
| ***F01D 5/02*** | (2006.01) |
| ***F01D 5/30*** | (2006.01) |
| ***F03B 1/02*** | (2006.01) |
| ***F03B 3/12*** | (2006.01) |
| ***F04D 29/18*** | (2006.01) |
| ***F04D 29/26*** | (2006.01) |

(52) U.S. Cl. ..... 415/141; 416/146 R

(58) Field of Classification Search ..... 416/146 R; 415/141

See application file for complete search history.

(56) References Cited

U.S. PATENT DOCUMENTS

| | | | | |
|---|---|---|---|---|
| 4,547,126 | A | 10/1985 | Jackson | |
| 6,116,855 | A * | 9/2000 | Maki | 416/146 R |
| 6,213,740 | B1 | 4/2001 | Barnes | |
| 6,264,450 | B1 | 7/2001 | Woodruff | |
| 6,394,753 | B1 | 5/2002 | Maki et al. | |
| 6,524,069 | B2 | 2/2003 | Chen | |
| 6,824,471 | B2 | 11/2004 | Kamenov | |
| 7,008,187 | B2 | 3/2006 | Cazzaniga | |
| 2001/0004447 | A1 | 6/2001 | Barnes | |

OTHER PUBLICATIONS

"Impeller Performance"; Sherwood 2006-2007 Maintenance and Repair Manual; pp. 9; Dec. 2005; HYPRO Pentair Water, Marine Products Group; New Brighton, MN, USA.

"Impeller Removal and Installation"; Sherwood 2006-2007 Maintenance and Repair Manual; pp. 13; Dec. 2005; HYPRO Pentair Water, Marine Products Group; New Brighton, MN, USA.

* cited by examiner

*Primary Examiner* — Ha Tran T Nguyen
*Assistant Examiner* — Aaron Dehne
(74) *Attorney, Agent, or Firm* — Quarles & Brady LLP

(57) ABSTRACT

Embodiments of the invention provide an impeller assembly having a flexible impeller and a method of replacing a removable drive mechanism. The impeller assembly includes an impeller having an outer portion defining a substantially cylindrical shape, at least one flexible blade extending radially outward from the outer portion, and a first bore extending a first axial length. The impeller assembly also includes a tubular insert supported at least partially within the first bore. The tubular insert has a second bore defining a substantially cylindrical shape with a first radial distance from an axis passing through the center of the impeller, and a key portion radially extending from the second bore. The key portion defines a second radial distance from the axis larger than the first radial distance.

17 Claims, 4 Drawing Sheets

FLEXIBLE IMPELLER APPARATUS AND METHOD

RELATED APPLICATIONS

This application claims priority under 35 U.S.C. §119 to U.S. Provisional Patent Application No. 60/999,893 filed on Oct. 22, 2007, the entire contents of which is incorporated herein by reference.

BACKGROUND

Flexible rubber impeller pumps are generally used in the marine industry as raw water coolant pumps for diesel and gasoline internal combustion engines. The pumps draw water from a lake or ocean and either pump it directly to an engine, as is the case of pleasure boat engines, or through a heat exchanger as is the case of larger diesel engines. The rubber impeller in this variety of pumps typically includes an insert of a metal or plastic and a number of flexible blades. The rubber impeller needs to be periodically replaced due to wear and deterioration over time. Most manufacturers of flexible rubber impeller pumps recommend that the impeller be replaced at least annually. In addition, impeller failure can occur prematurely from various reasons, such as the pump suction being blocked or running in an adverse environment and such as in running water saturated with silt, sand, or other corrosive materials.

In the case of marine engines, when an engine overheats, one common check for maintenance personnel is to evaluate the impellers in the pump, which could be under less than ideal conditions. Conditions contributing to the deterioration of the impellers usually include usage in an overheating engine, cramped engine compartment, usage of inadequate tools for maintenance, and possibly a boat which may be adrift in rough seas and foul weather. The removal of the impeller for checking and possibly replacing is further complicated by the presence of corrosion and the build up of deposits between the impeller insert and the shaft.

SUMMARY

Some embodiments of the invention provide an impeller assembly removably mounted into a pump. The impeller assembly includes an impeller having an outer portion defining a substantially cylindrical shape, at least one flexible blade extending radially outward from the outer portion, and a first bore extending a first axial length. The impeller assembly also includes a tubular insert supported at least partially within the first bore. The tubular insert has a second bore defining a substantially cylindrical shape with a first radial distance from an axis passing through the center of the impeller, and a key portion radially extending from the second bore. The key portion defines a second radial distance from the axis larger than the first radial distance.

DETAILED DESCRIPTION

Figure 1:
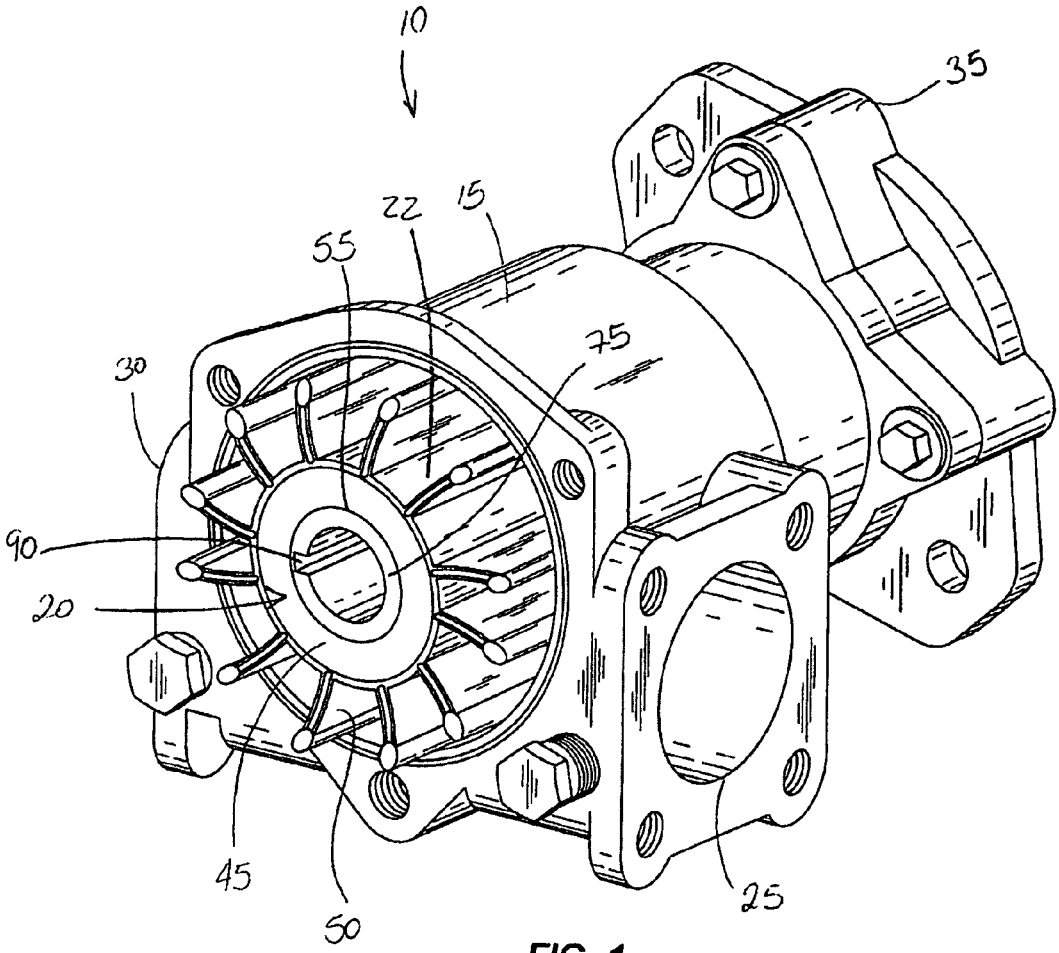
FIG. 1 is a perspective view of a pump assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
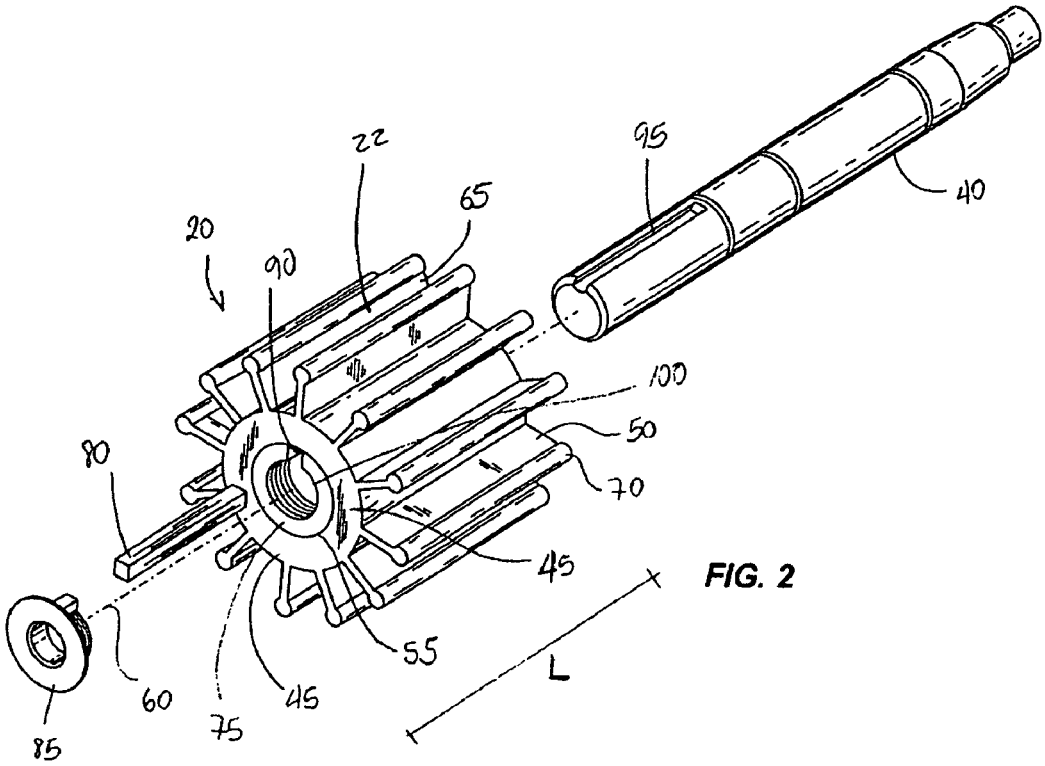
FIG. 2 is an exploded view of a shaft and a flexible impeller assembly for use with the pump assembly of FIG. 1.

FIG. 1 is an exploded view of a pump assembly 10 including an impeller housing 15 to support a flexible impeller assembly 20, a fluid inlet 25, a fluid outlet 30, and a connection portion 35 to connect the pump assembly 10 to a removable drive mechanism generally including a shaft 40 (as shown in FIG. 2). Other configurations of the pump assembly 10 are possible. For example, other constructions of the pump assembly 10 can include the fluid inlet 25 and the fluid outlet 30 oriented vertically (as opposed to horizontally as shown in FIG. 1). In other constructions, the pump assembly 10 can include a different connection portion 35 to connect the pump assembly 10 to any suitable mechanism operable to engage the flexible impeller assembly 20.

As shown in FIGS. 1-5, the flexible impeller assembly 20 includes a flexible impeller 22 with an outer portion 45 generally defining a cylindrical shape, a number of flexible blades 50 extending radially outward from the outer portion 45, and a first bore 55. As shown in FIG. 2, the flexible impeller assembly 20 extends a first axial length L along an axis 60. The outer portion 45 and flexible blades 50 of the impeller 22 are generally manufactured of a rubber-like or resilient material, although other suitable flexible materials can be used. The impeller assembly 20 also includes a tubular insert 75 with a key portion 90.

Figure 3:
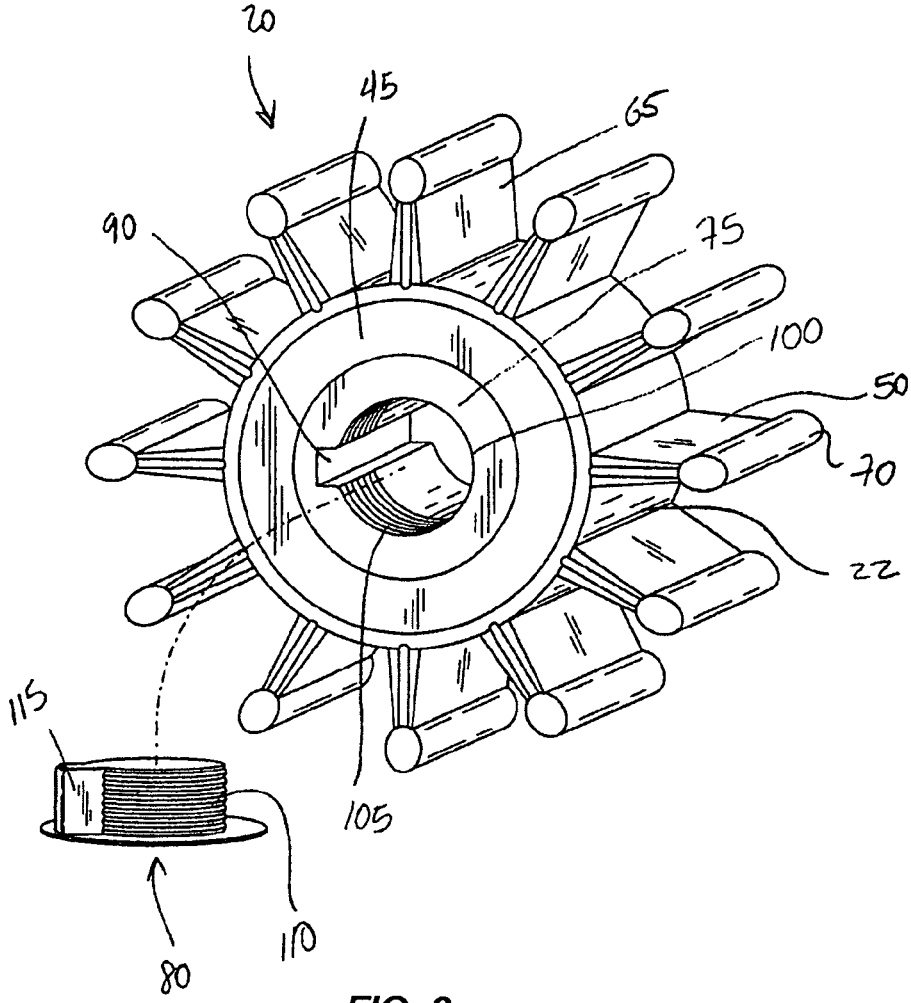
FIG. 3 is a perspective view of a flexible impeller and a cap of FIG. 2.

FIG. 2 illustrates the flexible impeller assembly 20 and the shaft 40. As shown in FIG. 2, the flexible impeller assembly 20 defines the axial length L. However, other constructions of the flexible impeller 20 can include the flexible impeller 22 defining a different axial length than the insert 75. Moreover, other constructions of the impeller 22 can include the flexible blades 50 defining a different axial length than the outer portion 45. Each flexible blade 50 includes a radially elongated portion 65 and an end portion 70 having generally the shape of a cylinder. Other configurations of the flexible blades 50 are also possible. For example, as shown in FIG. 3, the elongated portion 65 of the flexible blade 50 can define a substantially triangular sectional area. In other embodiments, the elongated portion 65 and the end portion 70 can define any suitable shape to provide desirable operating conditions of the pump assembly 10.

As shown in FIGS. 2 and 3, the pump assembly 10 also includes a key 80 and a cap 85. The tubular insert 75 is generally formed of a plastic material or a metal, and includes a key portion 90 to support the key 80, and a second bore 100 with a threaded end portion 105. The shaft 40 includes an axial groove 95 extending at one end of the shaft 40 generally parallel to the axis 60. At least a portion of the shaft 40 is generally supported within the second bore 100. In addition, the cap 85 includes a threaded portion 110 and a radial extension 115.

In one embodiment of the pump assembly 10, the shaft 40 can be inserted within the second bore 100 so that the axial groove 95 is supported within the tubular insert 75. Generally, the shaft 40 extends within the second bore 100 a second axial length which is smaller than the first axial length L defining the axial length of the flexible impeller assembly 20. The axial groove 95 and the key portion 90 are aligned and thus both are made operable to support the key 80 so as to substantially restrict rotation of the shaft 40 with respect to the flexible impeller assembly 20. Subsequently to inserting the key 80 within the groove 95 and the key portion 90, it is possible to mount the cap 85 at one end of the tubular insert 75 to axially support the key 80.

In some embodiments, the pump assembly 10 may be operated in a location that lacks sufficient space to comfortably maintain and operate the pump assembly 10. The impeller assembly 20 is operable for easy maintenance and replacement of a removable drive mechanism coupled to the pump assembly 10. A user can mount the flexible impeller assembly 20 onto the shaft 40, allowing the user to remove single-handedly the removable drive mechanism coupled to the flexible impeller assembly 20. One of the advantages of the flexible impeller assembly 20 is that the user performing maintenance does not need to manipulate the drive assembly to properly mount the impeller assembly 20 onto the shaft 40.

Figure 4:
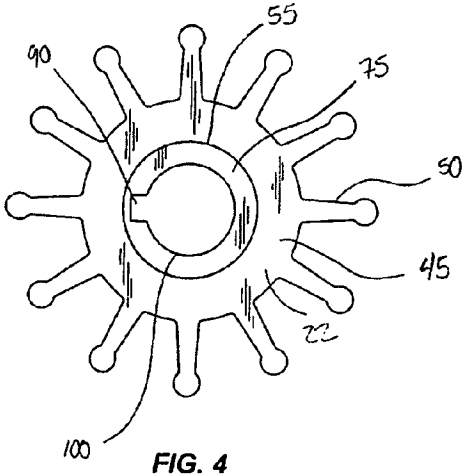
FIG. 4 is a front view of the flexible impeller of FIG. 3.

FIG. 4 illustrates the impeller assembly 20 including the key portion 90. The key portion 90 defines a second radial distance from the axis 60 that is greater than the radial distance defined by the second bore 100. Other embodiments of the flexible impeller assembly 20 can include the tubular insert 75 having none or more than one key portions 90. Moreover, the sectional view of the key portions 90 may be different from the one shown in FIG. 4. FIG. 2 also indicates that the general orientation of the flexible blades 50 and the key portion 90 is parallel to the axis 60. However, other orientations of the flexible blades 50 and the key portion 90 are possible.

Figure 5:
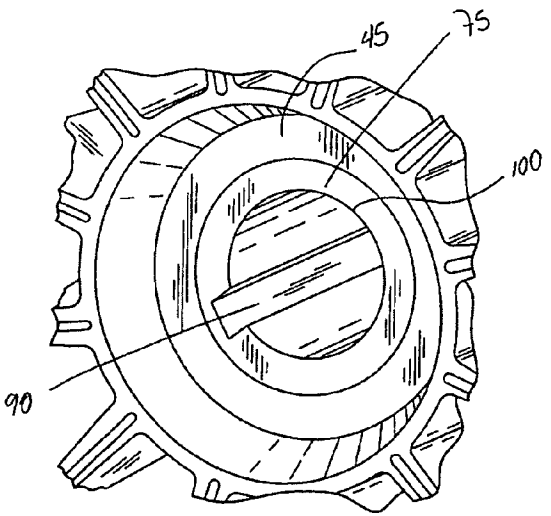
FIG. 5 is a partial perspective view of the flexible impeller of FIG. 1.

FIG. 5 illustrates another embodiment of the tubular insert 75 without a threaded portion. Frictional forces exerted between a cap and the surface of the second bore 100 can be sufficient to support the cap within the second bore 100. Additionally, other suitable methods or devices to support the key 80 substantially within the key portion 90 and the groove 95 are possible.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims.

The invention claimed is:

1. A pump assembly with an impeller assembly, the pump assembly comprising:

an impeller including an outer portion defining a substantially cylindrical shape, at least one flexible blade extending radially outward from the outer portion, and a first bore extending a first axial length; and a tubular insert supported at least partially within the first bore and having a second axial length, the tubular insert including a second bore defining a substantially cylindrical shape with a first radial distance from an axis passing through the center of the impeller, and a key portion radially extending from the second bore, the key portion defining a second radial distance from the axis larger than the first radial distance, the key portion extending a third axial length being equal to the second axial length of the tubular insert.

2. The pump assembly of claim 1, wherein the second axial length is substantially equal to the first axial length.

3. The pump assembly of claim 1, and further comprising a key at least partially supported within the key portion, the key being operable to align the impeller with a drive mechanism.

4. The pump assembly of claim 3, and further comprising a cap operable to be mounted at one end of the first bore to support the key.

5. The pump assembly of claim 4, wherein the cap includes a threaded portion and a radial extension at least partially supported in the key portion.

6. The pump assembly of claim 1, wherein the tubular insert includes a threaded end portion.

7. A pump assembly comprising:

an impeller assembly including a flexible impeller having an outer portion defining a substantially cylindrical shape, at least one flexible blade extending radially outward from the outer portion, and a first bore extending a first axial length, and a tubular insert at least partially supported within the first bore, the tubular insert having a second bore defining a substantially cylindrical shape with a first radial distance from an axis passing through the center of the impeller, and a key portion radially extending from the second bore, the key portion defining a second radial distance larger than the first radial distance;

a drive assembly including a shaft with a groove extending from one end of the shaft, the shaft extending within the second bore a distance shorter than the first axial length;

a key element at least partially supported within the key portion and the axial groove; and a cap operable to be mounted at one end of the tubular insert to support the key element.

8. The pump assembly of claim 7, wherein the tubular insert has a second axial length substantially equal to the first axial length.

9. The pump assembly of claim 7, wherein the tubular insert includes a threaded portion.

10. The pump assembly of claim 8, wherein the key portion extends a third axial length equal to the second axial length of the tubular insert.

11. The pump assembly of claim 7, wherein the cap includes a cylindrical portion defining a third radial distance substantially equal to the first radial distance of the second bore, and a radial extension at least partially supported within the key portion.

12. The pump assembly of claim 11, wherein the cylindrical portion includes a threaded portion.

13. The pump assembly of claim 7, wherein the second bore includes a threaded portion.

14. A method of replacing a removable drive mechanism, the method comprising:

providing an impeller assembly having a flexible impeller with a substantially cylindrical outer portion, and at least one flexible blade, and a tubular insert with a bore defining a first radial distance, and a key portion defining a second radial distance larger than the first radial distance;

providing a shaft with a groove extending from one end of the shaft;

aligning the key portion of the impeller assembly with the groove of the shaft;

inserting a key into the key portion and the groove; and securing the key into the groove and the key portion with a cap, the cap supporting the key.

15. The method of claim 14, wherein the impeller assembly extends a first axial length, the tubular insert has a second axial length, the key portion extends a third axial length, the third axial length being equal to the second axial length.

16. The method of claim 15, wherein the first axial length of the impeller assembly is substantially equal to the second axial length of the tubular insert.

17. The method of claim 14, wherein the cap includes a radial extension at least partially supported in the key portion of the tubular insert.

* * * * *